US011511780B2

(12) United States Patent
Sun et al.

(10) Patent No.: US 11,511,780 B2
(45) Date of Patent: Nov. 29, 2022

(54) CARRIAGE, HEAD CARRIAGE, MIDDLE CARRIAGE, AND TRAIN

(71) Applicant: CRRC TANGSHAN CO., LTD., Hebei (CN)

(72) Inventors: Hairong Sun, Tangshan (CN); Xiaoming Wu, Tangshan (CN); Yuanfei Wang, Tangshan (CN); Dahai Wang, Tangshan (CN); Chunxing Pei, Tangshan (CN); Jingfei Jin, Tangshan (CN); Tian He, Tangshan (CN); Yan Yang, Tangshan (CN); Xuefei Huang, Tangshan (CN); Jie Jiang, Tangshan (CN); Na Li, Tangshan (CN)

(73) Assignee: CRRC TANGSHAN CO., LTD., Hebei (CN)

( * ) Notice: Subject to any disclaimer, the term of this patent is extended or adjusted under 35 U.S.C. 154(b) by 402 days.

(21) Appl. No.: 16/627,328

(22) PCT Filed: Dec. 29, 2017

(86) PCT No.: PCT/CN2017/120236
§ 371 (c)(1),
(2) Date: Dec. 29, 2019

(87) PCT Pub. No.: WO2019/100532
PCT Pub. Date: May 31, 2019

(65) Prior Publication Data

US 2020/0231190 A1 Jul. 23, 2020

(30) Foreign Application Priority Data

Nov. 21, 2017 (CN) ..... 201711165946.3

(51) Int. Cl.
*B61L 15/00* (2006.01)
*B61G 5/10* (2006.01)
(Continued)

(52) U.S. Cl.
CPC ..... *B61L 15/0036* (2013.01); *B61G 5/10* (2013.01); *B61L 15/00* (2013.01); *B61L 15/0072* (2013.01); *B61L 25/028* (2013.01); *B61L 17/00* (2013.01)

(58) Field of Classification Search
CPC ..... B61G 5/10; B61G 15/00; B61G 15/0036; B61G 15/0072; B61G 17/00
See application file for complete search history.

(56) References Cited

U.S. PATENT DOCUMENTS 3,532,228 A * 10/1970 Beyer ..... H04Q 9/00 213/212
3,696,758 A * 10/1972 Godinez, Jr. ..... B61L 15/0036 246/8
(Continued)

FOREIGN PATENT DOCUMENTS

AU 2014201604 A1 9/2014
CA 2853950 A1 8/2014
(Continued)

OTHER PUBLICATIONS

International Search Report in the international application No. PCT/CN2017/120236, dated Jul. 26, 2018.
(Continued)

*Primary Examiner* — Zachary L Kuhfuss
(74) *Attorney, Agent, or Firm* — Syncoda LLC; Feng Ma

(57) ABSTRACT

A carriage comprises a carriage body (1) consisting of a top frame, side walls, and a bottom frame. An end wall (2) is disposed on at least one end of the carriage body (1). Connectors (3) are symmetrically disposed on the left side and the right side of an outer wall body of the end wall (2). All the connectors (3) disposed on the end wall (2) of the carriage are connected by means of lines. The carriages can be grouped into each train in a meal ordering manner. When each carriage is added into a high-speed train set, the
(Continued)

arrangement of the carriage is not limited, and accordingly, the carriage can be added into the train without limitation. On the premise the of ensuring the normal work of systems of the train, the work amount of staff members in a group can be reduced, and the work time of the staff members in the group is shortened.

14 Claims, 9 Drawing Sheets

(51) Int. Cl.
*B61L 25/02* (2006.01)
*B61L 17/00* (2006.01)

(56) References Cited

U.S. PATENT DOCUMENTS

| | | | | |
|---|---|---|---|---|
| 5,317,751 | A | 5/1994 | Novakovich | |
| 9,682,714 | B2 * | 6/2017 | Xu | B61C 17/00 |
| 2014/0360402 | A1 | 12/2014 | Koudolo et al. | |
| 2014/0376554 | A1 * | 12/2014 | Komura | H04L 69/22 370/394 |
| 2016/0075355 | A1 | 3/2016 | Kellner et al. | |
| 2017/0066455 | A1 * | 3/2017 | Xu | B61C 17/00 |
| 2018/0111631 | A1 * | 4/2018 | Prill | H01R 27/02 |
| 2020/0164843 | A1 * | 5/2020 | Chen | B60L 7/24 |
| 2021/0155095 | A1 * | 5/2021 | Hu | B61C 17/00 |

FOREIGN PATENT DOCUMENTS

| | | | | |
|---|---|---|---|---|
| CN | 2088065 | U | 11/1991 | |
| CN | 2840360 | Y | 11/2006 | |
| CN | 202448992 | U | 9/2012 | |
| CN | 203391796 | U | 1/2014 | |
| CN | 104554300 | A | 4/2015 | |
| CN | 204279427 | U | 4/2015 | |
| CN | 105059310 | A | 11/2015 | |
| CN | 105438222 | A | 3/2016 | |
| CN | 103921800 | B | 5/2016 | |
| CN | 106379349 | A | 2/2017 | |
| DE | 3220182 | C2 | 10/1984 | |
| DE | 20011549 | U1 | 10/2000 | |
| DE | 102004037849 | A1 * | 7/2005 | B61G 5/10 |
| EP | 0631550 | A1 | 1/1995 | |
| EP | 0711697 | B1 | 5/1996 | |
| WO | 2013124962 | A1 | 8/2013 | |

OTHER PUBLICATIONS

English translation of the Written Opinion of the International Search Authority in the international application No. PCT/CN2017/120236, dated Jul. 26, 2018.

Supplementary European Search Report in the European application No. 17932680.6, dated Jul. 13, 2020.

Prc Rail Consulting Ltd: "Electric Traction Control | The Railway Technical Website | PRC Rail Consulting Ltd", May 20, 2017 (May 20, 2017), XP055803618.

* cited by examiner

FL—Forward movement instruction train line 3-X-Y.3 denotes connector, X denotes end, Y denotes side;
RL—Backward movement instruction train line
BK——Braking instruction train line FL—Forward movement instruction train line 3-X-Y:3 denotes connector, X denotes end, Y denotes side;
RL—Backward movement instruction train line
BK——Braking instruction train line FL——Forward movement instruction train line 3—X—Y：3 denotes connector,X denotes end,Y denotes side
RL——Backward movement instruction train line
BK——Braking instruction train line FL—Forward movement instruction train line 3-X-Y:3 denotes connector, X denotes end, Y denotes side;
RL—Backward movement instruction train line
BK——Braking instruction train line

CARRIAGE, HEAD CARRIAGE, MIDDLE CARRIAGE, AND TRAIN

CROSS-REFERENCE TO RELATED APPLICATIONS

This application is a 35 U.S.C. 371 national stage filing of International Application No. PCT/CN2017/120236 filed Dec. 29, 2017, which claims priority to Chinese Patent Application No. 201711165946.3 filed Nov. 21, 2017. The entire contents of these above patent applications are hereby incorporated by reference in their entirety.

TECHNICAL FIELD

The present application relates to the technology of rail transportation, in particular to a car, a head car, a middle car, and a train.

BACKGROUND

The current high-speed train set is mainly marshaled in 8-car formation, and runs in an operating mode of 8-car formation, an operating mode of 16-car formation and a reconnection operating mode of two 8-car formations. However, the current formation mode of the high-speed train set is fixed, that is, the position and direction, in a whole train, of each car are stipulated when the car is designed, the formation type cannot be changed, and the number of cars included in the train also cannot be changed.

As illustrated in FIG. 1, in the marshaling process of the existing high-speed train set, the directions of a first end and a second end of each car are fixed. As illustrated in FIG. 2, the existing train line running through the whole train is in one-way and single-line arrangement.

In high-speed main line railways of our country, the running of high-speed train sets having 8 cars or 16 cars can solve the problem of large volume of passenger transport. But in some high-speed branch railways, especially in off-peak time for passenger transport, the high-speed train set having 8 cars may be too large, and the high-speed train set having a smaller number of cars is needed. An inter-city high-speed train set having 8 cars can meet an operation requirement in morning peak and evening peak, but in other time, the high-speed train set having 8 cars is slightly large. The formation of the existing high-speed train must be fixed, and customers have to purchase and overhaul the whole train, which does not adapt to the changes of passenger volume. When the occupancy rate of passengers is below 50%, the running of the train having 8 cars causes a waste; if a time interval of running the train is increased, the waiting time of the passengers is prolonged; besides, it is not convenient for overhaul and standby; if a car malfunctions, the whole train needs to be put in storage, which cannot meet the requirements of different customers.

After an arrangement mode of cars is determined in the process of designing a train, when the cars of the train are marshaled at any time thereafter, the arrangement mode of each car cannot be changed, that is, locations of the first end and the second end of the car cannot be turned when the car is arranged. If the train in FIG. 1 is rearranged into the case in FIG. 3, the cars 04 and 07 in the train cannot be marshaled normally, and an end connection system, a network system, and a door system thereof cannot be connected or perform wrong actions. Then, the workload and working time of staff marshaling is increased, and the staff has to adjust the direction of each car to the required direction, and then marshals the car.

A train line of the existing train running through the whole train is arranged at one side of the car. When a certain car is not arranged according to a predetermined direction during marshaling the train, the connection of the train line would go wrong. As illustrated in FIG. 3 and FIG. 4, if the marshaling way of the car T03 of the train in FIG. 3 turns 180 degrees, the connection, at the T03-connector 2-2 and the T03-connector 1-2, of the train line running through the whole train goes wrong.

SUMMARY

To solve one of the above technical problems, the present application provides a car including a car body consisting of a top frame, side walls, and a bottom frame, an end wall is provided on at least one end of the car body, connectors are symmetrically provided on a left side and a right side of the end wall;

all the connectors provided on the end wall of the car are connected by means of lines.

In an embodiment, the connector includes: an interface for forward movement instruction train line, an interface for backward movement instruction train line, and an interface for braking instruction train line;

a certain type of interface of each connector is connected with this type of interface of other connector by means of corresponding lines.

In an embodiment, sequences of arranging interfaces on the connectors at two sides of the end wall are axisymmetric.

In an embodiment, a junction box is provided in the car; and all connection lines of the connectors are interconnected through line sockets on the junction box.

In an embodiment, a coding module, which is configured to code a sequence and a type of current car, is provided in the car.

In an embodiment, the coding module adopts a six-digit coder, four output ends of the six-digit coder are configured to output a sequence number of the current car, and other two output ends of the six-digit coder are configured to output a type number of the car.

In an embodiment, the four output ends, which of the coder, which are configured to output the sequence number of the car, are respectively connected with an axle temperature alarm system, a traction converter, a door control system, a car control system, and a brake control system which are provided on the car;

the two output ends of the coder, which are configured to output the type number of the car, are respectively connected with the car control system and the brake control system.

In an embodiment, a power supply terminal of the six-digit coder is connected with a power source end, which is provided in the car and configured to supply power for a control device.

In an embodiment, the car body is further provided with a relay which is configured to control turning when a car turns 180 degrees; the relay is connected with an auxiliary control system provided in the car.

To solve one of the above technical problems, the present application further provides a train including the above-mentioned car.

To solve one of the above technical problems, the present application further provides a head car, including a cab body and a car body, one end of the cab body is fixedly connected with one end of the car body, other end of the car body is provided with an end wall, and connectors are symmetrically provided on a left side and a right side of an outer wall body of the end wall;

two connectors provided on the end wall are connected by means of lines.

In an embodiment, the connector includes: an interface for forward movement instruction train line, an interface for backward movement instruction train line, and an interface for braking instruction train line;

a certain type of interface of each connector is connected with this type of interface of other connector by means of corresponding lines;

sequences of arranging interfaces on the connectors at two sides of the end wall are axisymmetric.

To solve one of the above technical problems, the present application further provides a middle car, including: a top frame, side walls, and a bottom frame; the top frame is fixed with the bottom frame through the side walls, two ends of the middle car are provided with end walls, and connectors are symmetrically provided on a left side and a right side of an outer wall body of the end wall;

all the connectors provided on two end walls of the car are connected by means of lines.

In an embodiment, the connector includes: an interface for forward movement instruction train line, an interface for backward movement instruction train line, and an interface for braking instruction train line;

a certain type of interface of each connector is connected with this type of interface of other connector by means of corresponding lines;

sequences of arranging interfaces on the connectors at two sides of the end wall are axisymmetric.

In an embodiment, the middle car is a trailer car or a power car.

The present application has the following beneficial effects:

the technical solutions of the present application can marshal the cars of each train in a meal ordering manner, meet the different requirements of customers for a train; when it is not the peak time for passenger transport, adopting a high-speed train set with a small number of cars avoids the energy waste of a high-speed train set with a large number of cars, and does not increase the waiting time of passengers; when it is the peak time for passenger transport, adopting the high-speed train set with a large number of cars avoids the increase of workload of the Railways Bureau caused by increasing the number of trains.

By adopting the technical solutions of the present application, when each car is added into a high-speed train set, the arrangement of the car is not limited, and the car can be added into the train without limitation, thereby reducing the workload of staff marshaling the cars and shortening the work time of the staff marshaling the cars on the premise of ensuring the normal work of systems of the train.

1. car body; 2. end wall; 3. connector; 4. interface for forward movement instruction train line; 5. interface for backward movement instruction train line; 6. interface for braking instruction train line; 7. junction box.

DETAILED DESCRIPTION

In order to make the technical solutions and advantages in embodiments of the present application clearer, the exemplary embodiments in the present application are further elaborated below in combination with the accompanying drawings. It is apparent that the described embodiments are only a part of the embodiments of the present application but are not exhaustive of all the embodiments. It is to be noted that the embodiments in the present application and the characteristics in the embodiments may be combined under the condition of no conflicts.

The core concept of the present application is that: a dual-redundancy design is applied to a train line running through a whole train, that is, connectors 3 are symmetrically provided at a first side and a second side of a first end and a second end of a car, and all the connectors are connected by means of lines; when the car turns 180 degrees, train lines can still be connected effectively. At the same time, in order to cooperate free marshaling, a six-digit coder and a relay for controlling turning when a car turns 180 degrees are further added on a car; the number and type of a car after the free marshaling are adjusted by means of the six-digit coder, so that other components or systems of the train can identify the number and type of the current car, and then control the train according to the information. A power supply direction of the car is set by means of the relay, thereby assisting in setting a running direction of each power car and assisting other subsystems, and finally realizing unlimited marshaling of the train.

Figure 1:
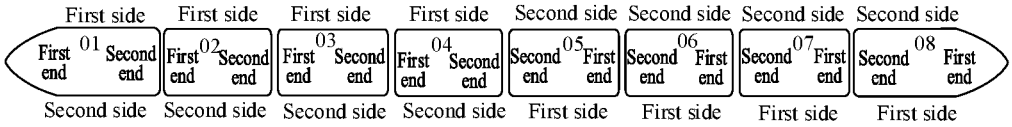
FIG. 1 is a schematic diagram of a train marshaling according to the related art.
Figure 2:
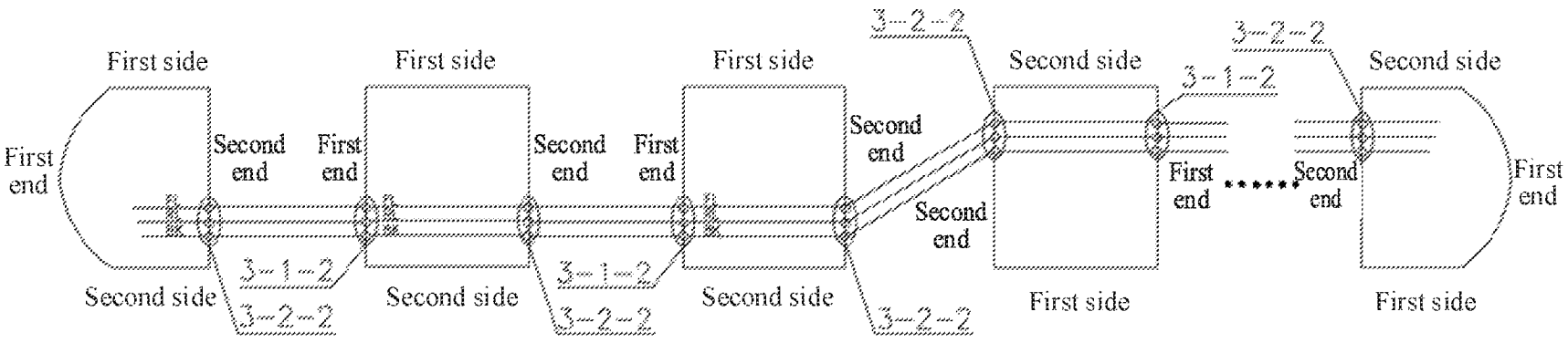
FIG. 2 is a schematic diagram of an arrangement of a train line and a connector according to the related art.
Figure 3:
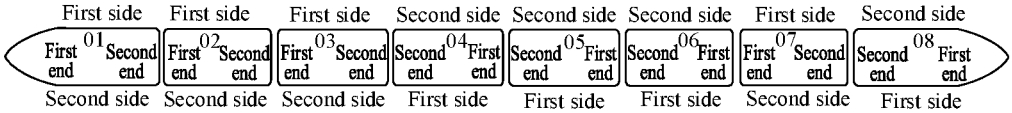
FIG. 3 is a schematic diagram of another train marshaling according to the related art.
Figure 4:
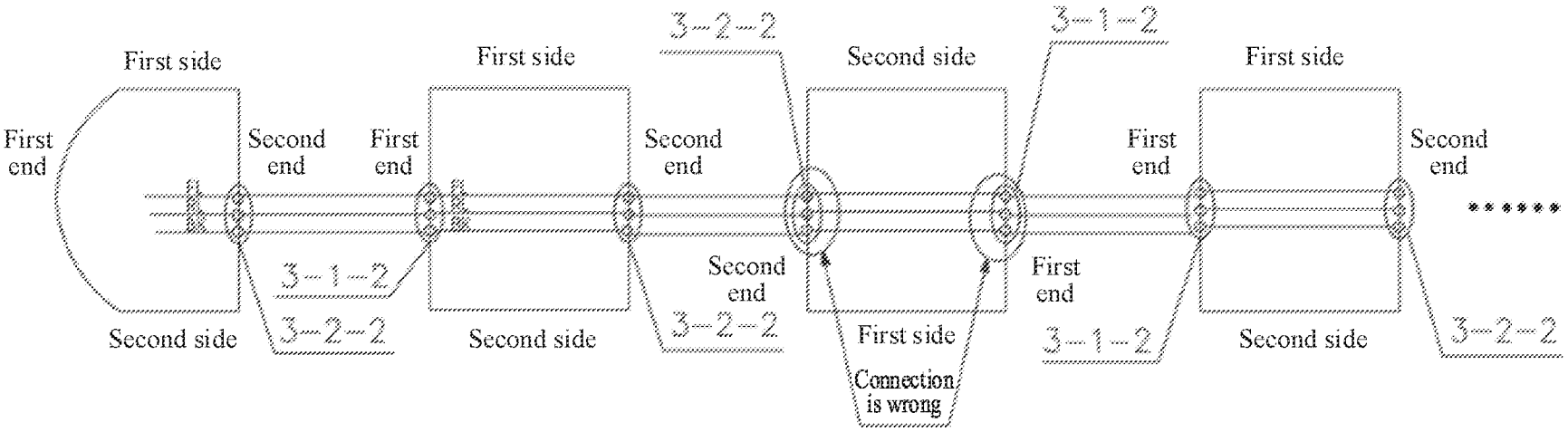
FIG. 4 is a schematic diagram of another arrangement of a train line and a connector according to the related art.
Figure 5:
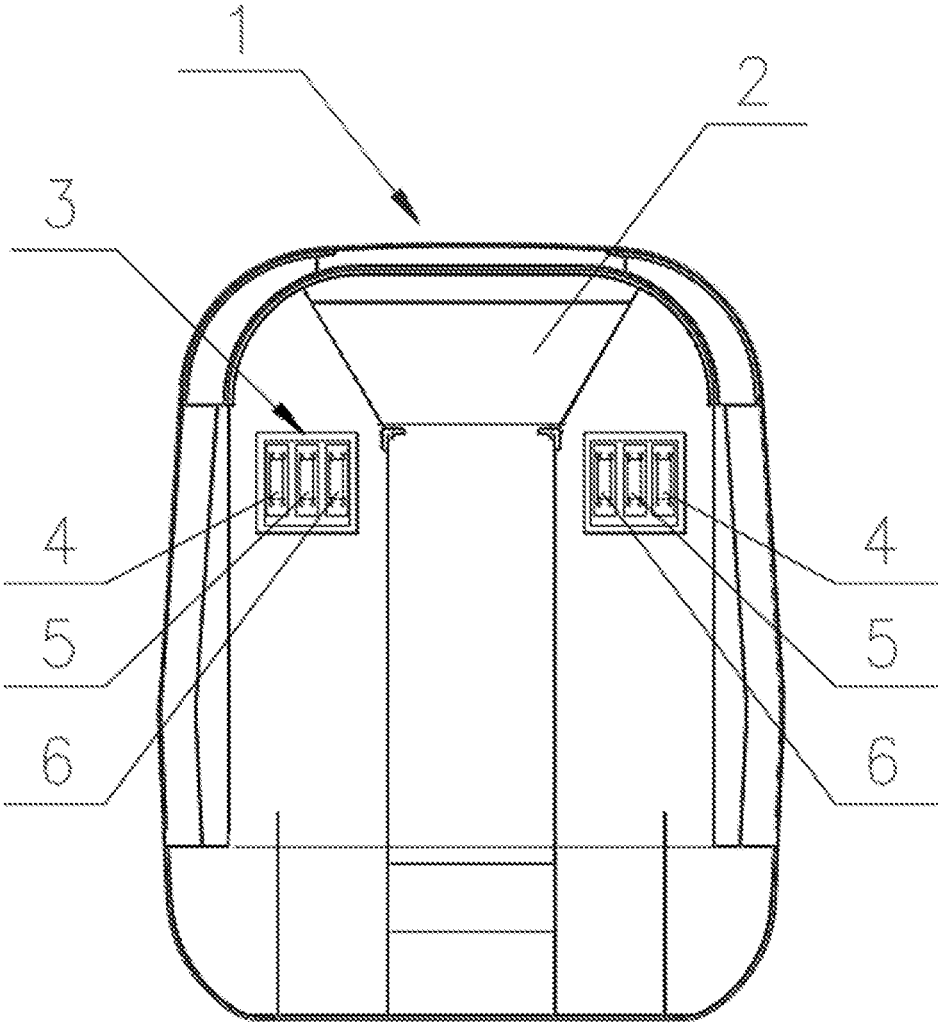
FIG. 5 is a schematic diagram of a setting position of a connector on an end wall of the car according to the present application.
Figure 6:
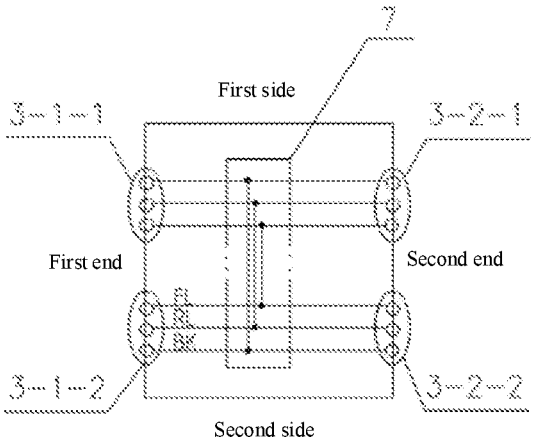
FIG. 6 is a schematic diagram of an arrangement of a train line and a connector according to the present application.

Specifically, as illustrated in FIG. 5 and FIG. 6, the present application discloses a car. The car includes a car body 1 consisting of a top frame, side walls, and a bottom frame. An end wall 2 is provided on at least one end of the car body 1. Connectors 3 are symmetrically provided on the left side and the right side of an outer wall body of the end wall 2. All the connectors 3 provided on the end wall 2 of the car are connected by means of lines. The connector 3 includes: an interface 4 for forward movement instruction train line, an interface 5 for backward movement instruction train line, and an interface 6 for braking instruction train line. A certain type of interface of each connector 3 is connected with this type of interface of other connector 3 by means of the corresponding lines. As illustrated in FIG. 4, in order to satisfy a marshal in which any car is added and a marshal of turning 180 degrees, the sequence of arranging the interface 4 for forward movement instruction train line, the interface 5 for backward movement instruction train line, and the interface 6 for braking instruction train line on the left connector 3 and the sequence of arranging the interface 4 for forward movement instruction train line, the interface 5 for backward movement instruction train line, and the interface 6 for braking instruction train line on the right connector 3 are axisymmetric, and the left connector 3 and the right connector 3 are on the same end wall 2.

In the present application, in order to facilitate arranging lines and managing the lines of each interface of the connector 3, a junction box 7 is further provided in the car, and the management and interconnection of all the lines are realized through line sockets set on the junction box 7. As illustrated in FIG. 6, all the lines of the connector 3 are arranged at two sides of the car, and are managed and collected at the junction box.

In order to further realize the flexible marshaling of the cars, the present application enables a train system and a train-related control and management system to learn information about the number and type of the car added, and provides a coding module which is composed of a plurality of breakers and configured to code the sequence and type of the current car. Preferably, in the solution, the coding module adopts a six-digit coder. Four output ends of the six-digit coder are configured to output the sequence number of the current car, and the other two output ends of the six-digit coder are configured to output the type number of the car. An output and display rule of the coder adopts a binary mode. When the formation is 16 columns, a numbering way is as shown in the following table.

TABLE 1

Code table of cars

| B0 | B1 | B2 | B3 | Car number |
|---|---|---|---|---|
| 0 | 0 | 0 | 1 | 1 |
| 0 | 0 | 1 | 0 | 2 |
| 0 | 0 | 1 | 1 | 3 |
| 0 | 1 | 0 | 0 | 4 |
| 0 | 1 | 0 | 1 | 5 |
| 0 | 1 | 1 | 0 | 6 |
| 0 | 1 | 1 | 1 | 7 |
| 1 | 0 | 0 | 0 | 8 |
| 1 | 0 | 0 | 1 | 9 |
| 1 | 0 | 1 | 0 | 10 |
| 1 | 0 | 1 | 1 | 11 |
| 1 | 1 | 0 | 0 | 12 |
| 1 | 1 | 0 | 1 | 13 |
| 1 | 1 | 1 | 0 | 14 |
| 1 | 1 | 1 | 1 | 15 |
| 0 | 0 | 0 | 0 | 16 |

There are two types of cars, namely a power car or a trailer car. When a code output of the power car is 01, the code output of the trailer car is 10. The code outputs represent the current type of the car. The coder in the car can be set manually or embedded in a train control system by writing program to code automatically.

Figure 7:
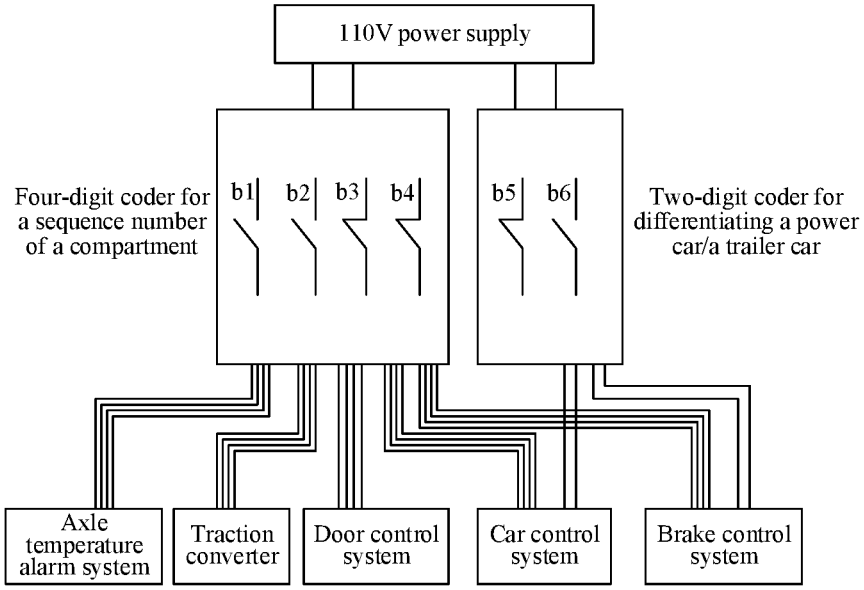
FIG. 7 is a schematic diagram of connection between a coder and other devices in the car according to the present application.

As illustrated in FIG. 7, the four output ends of the coder, which are configured to output the sequence number of the car, are respectively connected with an axle temperature alarm system, a traction converter, a door control system, a car control system, and a brake control system which are provided on the car. The two output ends of the coder, which are configured to output the type number of the car, are respectively connected with the car control system and the brake control system. Accordingly, other control systems in the car learn the number of the car, and inform all the other cars of the number and type of the car through a train network. In the solution, a power supply terminal of the six-digit coder is connected with a 110V power source end, which is provided in the car and configured to supply power for a control device in the car.

In the solution, in order to further realize the flexible marshaling after the car turns 180 degrees, relays, which are configured to control the turning when the car turns 180 degrees, are provided at an equipment box of the car, the junction box 7, a conductor room and other positions. The relay assists in setting the running direction of each car and switching power supply directions of other auxiliary systems.

The solution further discloses a train, which includes the above-mentioned car.

Moreover, the solution further discloses a head car including a cab body and a car body. One end of the cab body is fixedly connected with one end of the car body. The other end of the car body is provided with an end wall 2, and connectors 3 are symmetrically provided on a left side and a right side of an outer wall body of the end wall 2. Two connectors 3 provided on the end wall 2 are connected by means of lines. The connector 3 includes: an interface 4 for forward movement instruction train line, an interface 5 for backward movement instruction train line, and an interface 6 for braking instruction train line. A certain type of interface of each connector 3 is connected with this type of interface of other connector 3 by means of corresponding lines. The sequences of arranging interfaces on the connectors 3 at two sides of the end wall 2 are axisymmetric.

Moreover, the solution further discloses a middle car including a top frame, side walls, and bottom frame. The top frame is fixed with the bottom frame through the side walls. Two ends of the middle car are provided with end walls 2, and connectors 3 are symmetrically provided on a left side and a right side of an outer wall body of the end wall 2. All the connectors 3 provided on two end walls 2 of the car are connected by means of lines. The connector 3 includes an interface 4 for forward movement instruction train line, an interface 5 for backward movement instruction train line, and an interface 6 for braking instruction train line. A certain type of interface of each connector 3 is connected with this type of interface of other connector 3 by means of corresponding lines. The sequences of arranging interfaces on the connectors 3 at two sides of the end wall 2 are axisymmetric. In the solution, the type of the middle car is a trailer car or a power car.

The solution is further described through an example.

In the example, the types of basic cars included in a high-speed train set are: end power cars (head car and tail car), middle power cars (seat car and sleeping car), middle trailer cars (double-layer seat car, single-layer seat car, sleeping car, dining-seat car). The positions of the head car and the tail car of the train and the marshaling direction remain unchanged, and the number and directions of other cars can be changed arbitrarily.

In the example, the flexibly marshaled high-speed train set includes car body systems, bogies, braking systems, electric systems, doors, windows, seats and other basic equipment systems. The difference between devices on the power car and the trailer car is that there is a traction system (including a traction transformer, a traction converter, a traction motor, and so on) device mounted on the power car but there is no traction system device mounted on the trailer car.

In the example, a marshaling scheme about the flexibly marshaled train is as follows:

the connectors 3 are symmetrically provided on the left side and the right side of the end wall 2 of the train; the connector 3 includes: the interface 4 for forward movement instruction train line, the interface 5 for backward movement instruction train line, and the interface 6 for braking instruction train line; a certain type of interface of each connector 3 on the end wall 2 of the car is connected with this type of interfaces of other connector 3 by means of corresponding lines; and the sequences of arranging the interfaces on the connectors 3 at the left and right sides of each end wall 2 are axisymmetric. As illustrated in FIG. 5, the same type and the same number of the connectors 3 are respectively arranged at the two sides of the end wall 2, that is, the designs of the connectors 3 arranged at the two sides of the end of the car are completely axisymmetric. The train lines running through the whole train are in dual-redundant arrangement on the end of each car, so that each car in the train can be marshaled in any direction. As illustrated in FIG. XX, identical connectors 3 are respectively arranged at the first side of the first end, the second side of the first end, the first side of the second end, and the second side of the second end of each car. All the train lines adopt a double arrangement. One end of each train line adopting the double arrangement is connected in an electrical cabinet or the junction box in the car, and the other end thereof is respectively connected to four connectors 3 on the end of the car.

As illustrated in FIG. 7, the six-digit coder is provided in the car to set the current number and type of the car and enable all the cars in the train to learn the number and type of the car. The sequence number of the car after train formation is formed by 4-digit output codes of the coder. The other two output ports of the coder represent that the car is the power car or the trailer car. After the train formation is successful, the coder on each car is toggled, according to the actual characteristic and position of each car, to define the sequence number of the car.

Moreover, in order to further realize the flexible marshaling after the car turns 180 degrees, relays, which are configured to control the turning when the car turns 180 degrees, are provided at an equipment box of the car, the junction box 7, a conductor room and other positions. The relay assists in setting the running direction of each car and switching power supply directions of other auxiliary systems.

Figure 8:
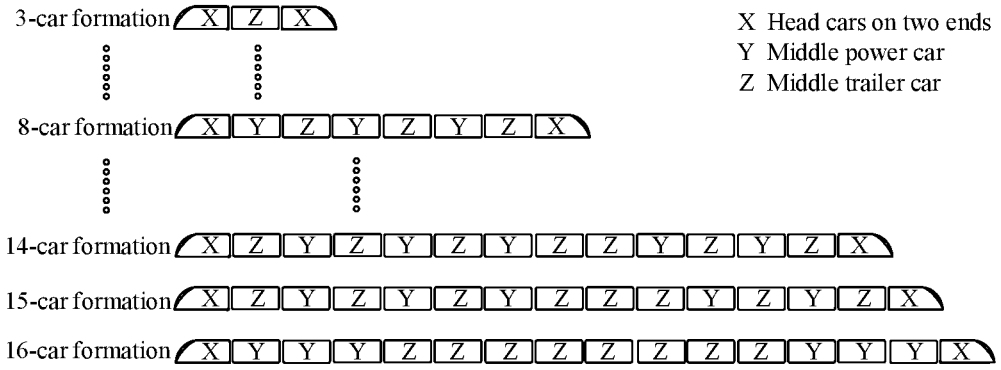
FIG. 8 is a schematic diagram of an example of flexibly marshaling the cars of a train according to the present application.

By means of the above solution, as illustrated in FIG. 8, the minimum formation type of a train can be 3-car formation, namely including the head cars on two ends and the middle car (the middle power car or the middle trailer car). The maximum formation type is 16-car formation, which must include the head cars on two ends and the middle cars. The number of the middle power cars and the middle trailer cars is configured according to the actual needs of customers. The formation of arbitrary number and arbitrary turning direction of the train can be performed according to the requirements for passenger flow and maintenance, or the requirements of other forms.

For example, in the example, a flexibly marshaled high-speed train set having 8 cars is provided; the cars 01, 03, 06 and 08 are the power cars, and the other cars are the trailer cars; except the head cars on two ends, the middle cars can be marshaled in any direction and sequence. Taking the car 03 for example to explain the display of the number and type, if the number of the car 03 is defined in binary code as 0011 and the type of the car 03 is 10, the coder of the car 03 is set to 001110. After the coder is set, all control units of a traction converter, a door control system, a train network system, an axle temperature alarm system and the braking system, which are connected with the coder, learn the information about the number and type of the car from the coder in the car.

Figure 9:
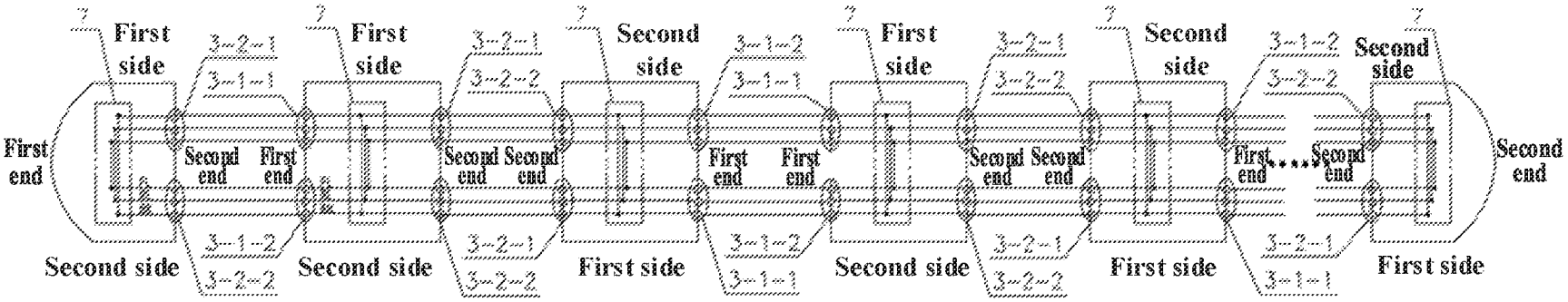
FIG. 9 is a schematic diagram of an arrangement of a train line and a connector in the example of flexibly marshaling the cars of a train according to the present application.

As illustrated in FIG. 9, the relay, which is configured to control the turning when the car turns 180 degrees, is used to implement the function of turning 180 degrees of the car, thus there is no need to consider the directions of the first end and the second end of each car during marshaling, and the cars can be marshaled arbitrarily.

The technical solutions of the present application can marshal 3-16 cars of each train in a meal ordering manner, meet the different requirements of customers for a train; when it is not the peak time for passenger transport, adopting a high-speed train set with a small number of cars avoids the energy waste of a high-speed train set with a large number of cars, and does not increase the waiting time of passengers; when it is the peak time for passenger transport, adopting the high-speed train set with a large number of cars avoids the increase of workload of the Railways Bureau caused by increasing the number of trains.

By adopting the technical solutions of the present application, when each car is added into a high-speed train set, the arrangement of the car is not limited, and the car can be added into the train without limitation, thereby reducing the workload of staff marshaling the cars and shortening the work time of the staff marshaling the cars on the premise of ensuring the normal work of systems of the train.

The technical solution of the present application can realize the application of flexible marshaling and interchange overhaul of a high-speed train set, reduces the inspection rate by more than 10%, reduces the overhaul and maintenance cost by more than 15%, and reduces the cost of one-time purchase by more than 20%, thus the economic benefit of maintaining the cars is remarkable.

It is apparent that those skilled in the art may make various modifications and changes to the present application without departing from departing from its spirit and scope. If these modifications and variations of the present application belong to the scope of the claims of the present application and its equivalent technology, the present application is intended to include these modifications and variations.

The invention claimed is:

1. A car, comprising: a car body consisting of a top frame, side walls, and a bottom frame; an end wall is provided on at least one end of the car body; wherein, connectors are symmetrically provided on a left side and a right side of the end wall;

all the connectors provided on the end wall of the car are connected by means of lines, wherein a coding module, which is configured to code a sequence and a type of current car, is provided in the car, the coding module adopts a six-digit coder, four output ends of the six-digit coder are configured to output a sequence number of the current car, and other two output ends of the six-digit coder are configured to output a type number of the car.

2. The car of claim 1, wherein the connector comprises: an interface for forward movement instruction train line, an interface for backward movement instruction train line, and an interface for braking instruction train line;

the interface for forward movement instruction train line of each connector is connected with an interface for forward movement instruction train line of other connector by means of corresponding lines;

the interface for backward movement instruction train line of each connector is connected with an interface for backward movement instruction train line of other connector by means of corresponding lines;

the interface for braking instruction train line of each connector is connected with an interface for braking instruction train line of other connector by means of corresponding lines.

3. The car of claim 2, wherein sequences of arranging interfaces of the connectors at two sides of the end wall are axisymmetric.

4. The car of claim 3, wherein a junction box is provided in the car; and all connection lines of the connectors are interconnected through line sockets on the junction box.

5. The car of claim 1, wherein the four output ends of the coder, which are configured to output the sequence number of the car, are respectively connected with an axle temperature alarm system, a traction converter, a door control system, a car control system, and a brake control system which are provided on the car;

the two output ends of the coder, which are configured to output the type number of the car, are respectively connected with the car control system and the brake control system.

6. The car of claim 1, wherein a power supply terminal of the six-digit coder is connected with a power source end, which is provided in the car and configured to supply power for a control device.

7. The car of claim 1, wherein the car body is further provided with a relay which is configured to control turning when the car turns 180 degrees;

the relay is connected with an auxiliary control system provided in the car.

8. A middle car, comprising: a top frame, side walls and a bottom frame; the top frame is fixed with the bottom frame through the side walls; wherein, two ends of the middle car are provided with end walls, and connectors are symmetrically provided on a left side and a right side of an outer wall body of the end wall;

all the connectors provided on two end walls of the car are connected by means of lines, wherein a coding module, which is configured to code a sequence and a type of current middle car, is provided in the middle car, wherein the coding module adopts a six-digit coder, four output ends of the six-digit coder are configured to output a sequence number of the current middle car, and other two output ends of the six-digit coder are configured to output a type number of the middle car.

9. The middle car of claim 8, wherein the connector comprises: an interface for forward movement instruction train line, an interface for backward movement instruction train line, and an interface for braking instruction train line;

the interface for forward movement instruction train line of each connector is connected with an interface for forward movement instruction train line of other connector by means of corresponding lines;

the interface for backward movement instruction train line of each connector is connected with an interface for backward movement instruction train line of other connector by means of corresponding lines;

the interface for braking instruction train line of each connector is connected with an interface for braking instruction train line of other connector by means of corresponding lines;

sequences of arranging interfaces on the connectors at two sides of the end wall are axisymmetric.

10. The middle car of claim 9, wherein a junction box is provided in the middle car; and all connection lines of the connectors are interconnected through line sockets on the junction box.

11. The middle car of claim 8, wherein the middle car is a trailer car or a power car.

12. The middle car of claim 8, wherein the four output ends of the coder, which are configured to output the sequence number of the middle car, are respectively connected with an axle temperature alarm system, a traction converter, a door control system, a car control system, and a brake control system which are provided on the middle car;

the two output ends of the coder, which are configured to output the type number of the middle car, are respectively connected with the car control system and the brake control system.

13. The middle car of claim 8, wherein a power supply terminal of the six-digit coder is connected with a power source end, which is provided in the middle car and configured to supply power for a control device.

14. The middle car of claim 8, wherein the middle car comprises a car body, the car body consists of the top frame, the side walls and the bottom frame, and the car body is further provided with a relay which is configured to control turning when the middle car turns 180 degrees;

the relay is connected with an auxiliary control system provided in the middle car.

* * * * *